US012207678B2

(12) United States Patent
Qian et al.

(10) Patent No.: US 12,207,678 B2
(45) Date of Patent: Jan. 28, 2025

(54) FILTER COMPONENT FOR SMOKING

(71) Applicant: SOUL-TOUR ELECTRONICS (HUIZHOU) CO., LTD, Huizhou (CN)

(72) Inventors: Jianbing Qian, Huizhou (CN); Baoming Zhan, Huizhou (CN); Qin Hua, Huizhou (CN)

( * ) Notice: Subject to any disclaimer, the term of this patent is extended or adjusted under 35 U.S.C. 154(b) by 389 days.

(21) Appl. No.: 17/642,313

(22) PCT Filed: Sep. 2, 2020

(86) PCT No.: PCT/CN2020/112927

§ 371 (c)(1),
(2) Date: Mar. 11, 2022

(87) PCT Pub. No.: WO2021/052172

PCT Pub. Date: Mar. 25, 2021

(65) Prior Publication Data

US 2023/0000139 A1 Jan. 5, 2023

(30) Foreign Application Priority Data

Sep. 18, 2019 (CN) ..... 201910885130.0

(51) Int. Cl.
*A24D 3/00* (2020.01)
*A24D 3/02* (2006.01)
(Continued)

(52) U.S. Cl.
CPC ..... *A24D 3/063* (2013.01); *A24D 3/0287* (2013.01); *A24D 3/04* (2013.01)

(58) Field of Classification Search
None
See application file for complete search history.

(56) References Cited

U.S. PATENT DOCUMENTS 5,666,976 A * 9/1997 Adams ..... A24D 1/20 131/194
10,405,576 B1 * 9/2019 Adams ..... A24D 3/06
(Continued)

FOREIGN PATENT DOCUMENTS

CA 2531808 A1 3/2005
CN 1819780 A 8/2006
(Continued)

OTHER PUBLICATIONS

1st Japanese Office Action for Japanese Application No. 2022-517846, dated Apr. 11, 2023 (Apr. 11, 2023)—5 pages (English translation—6 pages).
(Continued)

*Primary Examiner* — Russell E Sparks
*Assistant Examiner* — John Mitchell Martin
(74) *Attorney, Agent, or Firm* — CM Law; Stephen J. Weed

(57) ABSTRACT

A filter component for tobacco smoking, comprises a filter body (1), a filter core material (2), and a filter closing layer (3). The filter body (1) is a hollow cylinder, and the filter core material (2) is built in the filter body (1). At least one end of the filter body (1) is closed by the filter closing layer (3). The filter core material (2) is a granular filter material, filament filter material, folded filter material, or similar filter material having a shape structure with a large specific surface area. The filter component for smoking can be widely used in the field of tobacco and can be built into cigarettes or arranged in related accessories. The filter component for smoking can effectively filter moisture and tar in smoke, and can also ensure good smoking feel and effect.

2 Claims, 5 Drawing Sheets

(51) Int. Cl.
*A24D 3/04* (2006.01)
*A24D 3/06* (2006.01)

(56) References Cited

U.S. PATENT DOCUMENTS

| | | | | |
|---|---|---|---|---|
| 2005/0121044 | A1 | 6/2005 | Banerjee et al. | |
| 2011/0271968 | A1* | 11/2011 | Carpenter | A24D 3/048 131/342 |
| 2016/0106147 | A1* | 4/2016 | Lisan | A24D 3/0279 |
| 2020/0107574 | A1* | 4/2020 | Inagaki | A24D 3/0212 |
| 2020/0229487 | A1* | 7/2020 | Cao | A24D 3/08 |
| 2022/0079215 | A1* | 3/2022 | Luo | A24D 3/14 |
| 2022/0175034 | A1* | 6/2022 | Papakyrillou | A24F 40/70 |

FOREIGN PATENT DOCUMENTS

| | | | |
|---|---|---|---|
| CN | 201299093 | Y | 9/2009 |
| CN | 201781967 | U | 4/2011 |
| CN | 201781975 | U | 4/2011 |
| CN | 110893009 | A | 3/2020 |
| CN | 210960404 | U | 7/2020 |
| JP | 2007519507 | A | 7/2007 |
| WO | 2003020057 | A1 | 3/2003 |
| WO | 2011118042 | A1 | 9/2011 |

OTHER PUBLICATIONS

International Search Report for International Application No. PCT/CN2020/112927 dated Dec. 1, 2020 (Dec. 1, 2020)—7 pages (English translation—4 pages).

* cited by examiner

FILTER COMPONENT FOR SMOKING

FIELD OF THE INVENTION

The present invention relates to the field of smoke treatment in the tobacco industry, in particular to a smoke filtration technology for smoking.

BACKGROUND

In recent years, with rapid economic development of the tobacco industry and continuous increase of sales amount of traditional cigarettes, novel tobacco technology continues to innovate and develop. With continuous improvement of people's requirements for healthy life, the control of smoke treatment in the tobacco industry is becoming stricter. For the traditional cigarettes, since the smoke contains a lot of harmful substances such as nicotine and tar, fiber filters are often used as smoke treatment components to filter the smoke. In order to improve filtering effect, cigarette manufacturers often attach external filters at cigarette filter sections to filter the smoke.

However, in the technical field of heated unburned tobacco, in addition to aromatic substances, the ingested smoke also contains substances such as tobacco tar, nicotine and polyols which will lead to oral irritation, which is further harmful to the health of consumers. Take the heated unburned tobacco products of Marlboro brand with the highest market share at present as an example, smoke is treated by assembling fiber cylinders, polyurethane fiber membranes and fiber filters as smoke treatment components. That is, the polyurethane fiber membrane is rolled into a cylindrical shape, and gaps between the fiber membrane folds are used to filter the smoke. Since a channel formed by the gaps between the fiber membrane folds is consistent with the smoke flow direction, there is no obvious smoking resistance. However, polyurethane is a polymer material having complex and expensive manufacturing methods. More importantly, according to relevant research reports, polyurethane will volatilize toxic substances after heating at high temperature, which will endanger human health.

At present, relevant enterprises in the industry have proposed that calcium oxide particles can be placed in the cigarette holder filter or heated unburned cigarette as filter components since calcium oxide has the properties of adsorbing oily and water-based substances. However, special chemical smell of the calcium oxide particles will affect the smoking taste of tobacco and its derivatives. In addition, since the calcium oxide particles are granular, it is hard to be maintained in the heated unburned cigarettes. In view of this problem, in the prior art, position and volume of the calcium oxide particles in the heated unburned cigarette are controlled by arranging a ventilation baffle. However, this structure has a problem that the calcium oxide particles will squeeze tobacco derivative sections, thereby causing inner blockage of the vent tube, thus increasing the smoking resistance.

Therefore, the industry is eager to find a non-toxic and odorless filter component for smoking without obvious smoking resistance so as to be widely used in the smoke filtration of various tobacco products.

SUMMARY

In order to solve the above problems in the prior art, the object of the present invention is to provide a filter component for smoking which can effectively filter moisture and tar in smoke and ensure good smoking feel and effect, and can be widely used in various cigarettes or cigarette devices.

Based on the inventive concept, the present application proposes the following technical solution.

That is, the present invention provides a filter component for tobacco smoking which comprises a filter body, a filter core material and a filter closing layer; the filter body is a hollow cylinder, the filter core material is built in the filter body, at least one end of the filter body is closed by the filter closing layer, and the filter core material is a granular filter material, filament filter material, folded filter material or similar filter material having a shape structure with a large specific surface area. Since the filter component provided by the present invention uses organic combination of the above specific structure and the filter material having a shape structure with a large specific surface area (e.g., granular filter material, filament filter material or folded filter material), the filtering effect of the moisture and tar in the smoke is effectively improved, and the filter material will not block the vent channel of the filter component, thus providing good smoking feel and effect.

As an important aspect of the present invention, for the granular filter material, the smaller the particle size, the larger the specific surface area, and the better the smoke adsorption and filtration effect. However, too small particle sizes will affect gaps between the granular filter materials, which greatly reduces permeation effect and increases the smoking resistance, thus reducing the smoking feel. In view of this, the inventors found through a large number of experimental researches that this problem can be effectively solved if the particle size of the granular filter material is 250-3000 μm.

Similarly, addition amount of the granular filter material will also have an important impact on the filtration and smoking effect. In view of this, the inventors found through a large number of experimental researches that the problem can be effectively solved if the addition amount of the granular filter material accounts for ⅕-⅘ of a volume of the filter body, and more preferably, if the addition amount of the granular filter material accounts for ⅕ of the volume of the filter body.

Through research, the inventors found that among various filter materials, polypropylene resin has advantages of maximum water and oil absorption efficiency and maximum adsorptive capacity. Therefore, in the present invention, the filter core material is preferably of polypropylene resin particles. Further experimental research revealed that the polypropylene resin particles also have the characteristics of expansion and softening after adsorbing water. Therefore, in view of the filtration and adsorption effect and permeation effect, the particle size of the polypropylene resin particles are preferably set to 750-1500 μm.

Another important aspect of the present invention is that as another form of the filter core material having the shape structure with the large specific surface area, the present invention proposes use of the filament filter material. In the research and development of the filter material, the inventors found that for the filament filter material, linear density of the filament will directly affect smoking resistance amplitude and stability of the filament. In order to solve the problem, the inventors found through a large number of experimental researches that the filament filter material is preferably of a filament with a linear density of 3-6 ktex. More preferably, the filament filter material is of a filament with a linear density of 3.2-4.2 ktex.

A still further important aspect of the present invention is that as another form of the filter core material having the shape structure with the large specific surface area, the present invention proposes that the filter material adopts a folded filter material. By making full use of the film-forming property of the folded filter material itself, an adsorbing material is made into a membrane which is then folded into a cylindrical shape, and the gaps formed by folds are used to realize effective filtration of the smoke when the smoke flows through. For the folded filter material, the adsorbing material is preferably used as a matrix, and a filter absorbing material is laid or sprayed on the matrix. The filter absorbing material can be of granular material, resin slurry or fiber filament, preferably ceramic particles, polypropylene resin particles, polypropylene resin slurry, polylactic acid fiber filament or similar material.

A yet still further aspect of the present invention is that a plurality of cavities can be arranged inside the filter body, and the filter core material is arranged in the cavities. The plurality of cavities are preferably arranged along an axial direction of the filter body.

A yet further aspect of the present invention is that an independent cylindrical filter core material is arranged in the filter body. More preferably, a plurality of cylindrical filter core materials are arranged, and the cylindrical filter core materials are arranged adjacent to and against each other in the filter body, so that gaps between the cylindrical filter core materials and the interior of the cylindrical filter core materials form air flow filtration channels.

In addition, the filter body is preferably molded from starch. The inventors found that the use of starch as the filter body can makes full use of advantages of sufficient starch source, degradable, environment-friendly and hygienic, and convenience to mold channels with various structures in the filter body.

In addition, air permeability of the filter closing layer is preferably higher than 12000 CU. More preferably, the filter closing layer use pure wood pulp paper with the air permeability higher than 26000 CU. A through hole of the filter body should have a total cross section area not less than 5 $mm^2$.

In conclusion, the filter component for smoking provided by the present invention can effectively isolate tobacco and derivatives thereof, thus being capable of fully drying and filtering the smoke, and the smoking resistance is small, thus ensuring the smoking taste, and meeting the requirements of being hygienic and environment-friendly. Therefore, the filter component for smoking is suitable to be widely used in the field of tobacco such as cigarette, heated unburn tobacco and steam e-cigarette.

1—filter body, 2—filter core material, 3—filter closing layer.

EMBODIMENTS

Embodiments of the present invention will be described in detail below in conjunction with the accompanying drawings.

Embodiment 1

Figure 1:
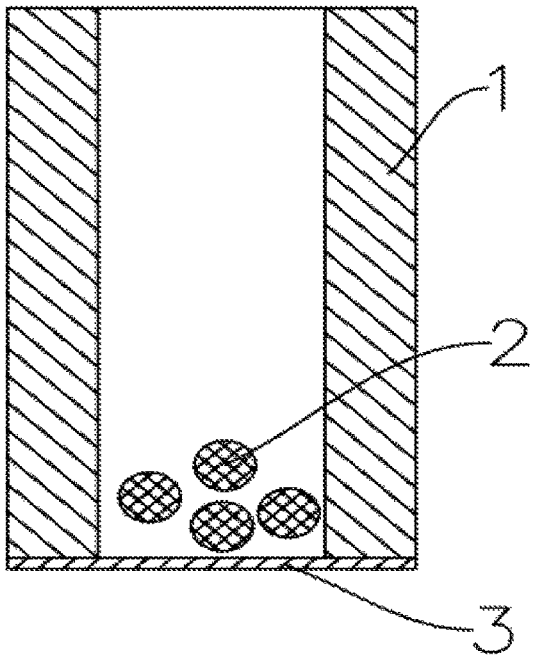
FIG. 1 is a structural diagram showing a filter component for smoking according to embodiment 1 of the present invention.
Figure 2:
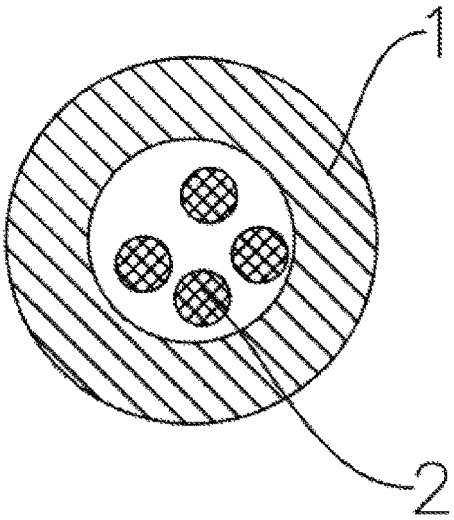
FIG. 2 is a schematic diagram of a cross section of the filter component for smoking according to embodiment 1.

As shown in FIGS. 1 and 2, the filter component for smoking according to embodiment 1 of the present invention comprises a filter body 1, a filter core material 2 arranged in the filter body 1 and a filter closing layer 3, where one end of the filter body 1 is closed by the filter closing layer 3. The filter body 1 is a hollow paper cylinder rolled and pressed by a strip winding machine, and the filter closing layer 3 is fixed on one end face of the filter body 1 through food grade water-based adhesive.

For embodiment 1, it should be noted that the inventors conducted careful research based on many factors such as air permeability, flexibility and smoking resistance during smoke filtration. A large number of tests have proved that the filter closing layer 3 is preferably of 50 $g/m^2$ spunlace non-woven cotton, and the filter core material 2 is preferably of polypropylene resin particles with a particle size of 1000 μm which accounts for ⅕ of a volume of the filter body 1. Use of the above parameters enables an ideal combination between the filter body 1, the filter core material 2 and the filter closing layer 3 in embodiment 1 of the present invention, thus achieving the best filterability, air permeability, flexibility and smoking feel of the filter component.

Embodiment 2

Figure 3:
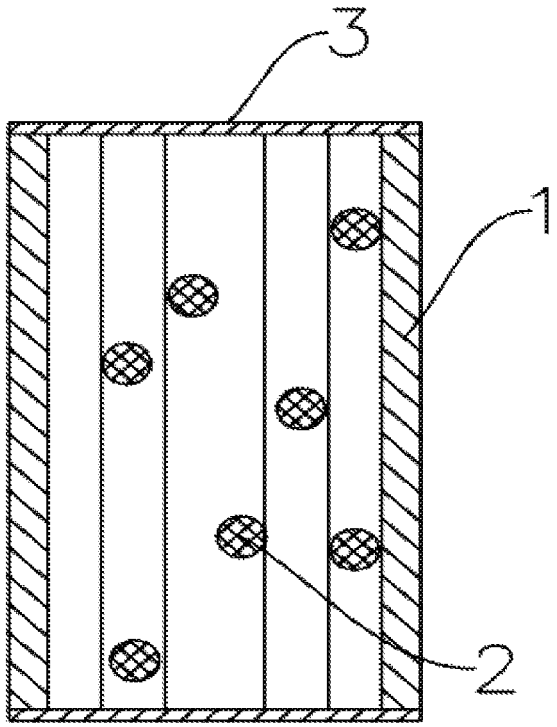
FIG. 3 is a schematic diagram showing the structure of a filter component for smoking according to embodiment 2 of the present invention.
Figure 4:
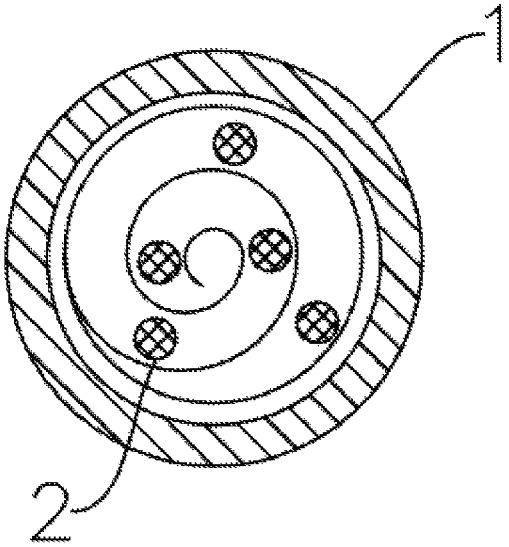
FIG. 4 is a schematic diagram of a cross section of the filter component for smoking according to embodiment 2.

As shown in FIGS. 3 and 4, the filter component for smoking according to embodiment 2 of the present invention comprises a filter body 1, a filter core material 2 arranged in the filter body 1 and a filter closing layer 3, where both ends of the filter body 1 are closed by the filter closing layer 3 through food grade water-based adhesive. The filter body 1 is a hollow paper cylinder rolled by a spiral paper cylinder winding machine. In order to ensure no oil and water seepage, the paper cylinder can be of a three-layer structure or waterproof and oil-proof paper.

In embodiment 2, in order to have ideal smoking resistance and suitable smoke volume in practical application, the filter closing layer 3 is of high-permeability pure wood pulp paper with an air permeability of 26000 CU.

Moreover, the inventors also found that ceramic particles not only have the characteristics of water and oil absorption, but also have excellent cooling effect, and can effectively avoid excessive high temperature of the smoke when smoking. Therefore, the filter core material 2 is of ceramic particles. Further experimental research revealed that the particle size of the ceramic particles used in the filter core material 2 is preferably 800 μm. In addition, considering the inventive concept of effectively filtering smoke, in embodiment 2, the inventors adopted a specific structure for the filter core material 2, that is, as shown in FIGS. 3 and 4, the ceramic particles are spread on the surface of spunlace non-woven cotton, the spunlace non-woven cotton is rolled in a loose roll shape, and arranged in the hollow structure of the filter body 1 as the filter core material. Tests show that this filter core material structure makes full use of the fluffy characteristics of spunlace non-woven cotton, and rolled folds thereof can effectively divert and cool the smoke, and make the smoke pass more evenly. In addition, cotton fibers are provided with the ceramic particles, which further increase contact area of the smoke and improve efficiency of water and oil absorption.

Embodiment 3

Figure 5:
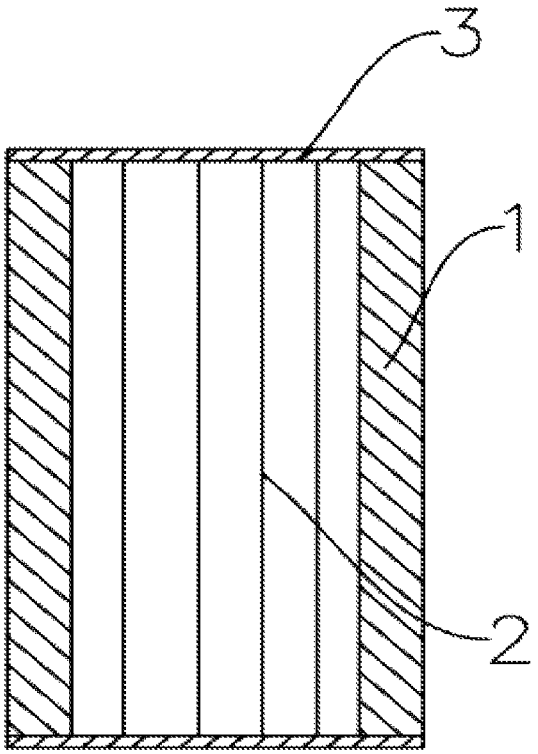
FIG. 5 is a structural diagram showing a filter component for smoking according to embodiment 3 of the present invention.
Figure 6:
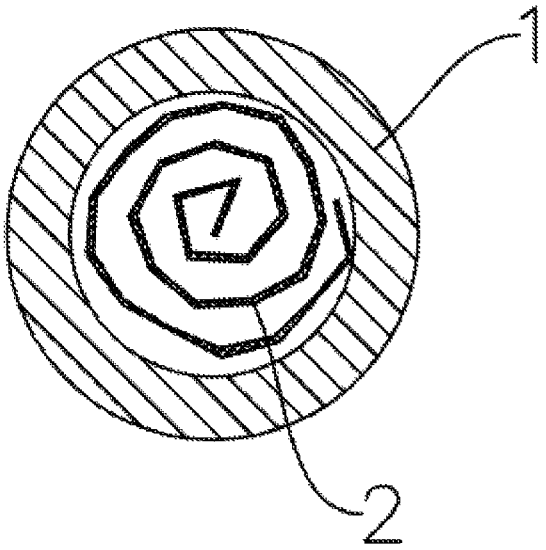
FIG. 6 is a schematic diagram of a cross section of the filter component for smoking of embodiment 3.

As shown in FIGS. 5 and 6, the filter component for smoking according to embodiment 3 of the present invention comprises a filter body 1, a filter core material 2 and a filter closing layer 3, where both ends of the filter body 1 are closed by the filter closing layer 3 through food grade water-based adhesive. The filter body 1 is a hollow paper cylinder rolled by a spiral paper cylinder winding machine.

In embodiment 3, the filter closing layer 3 is of jute paper with an air permeability of 24000 CU. The filter core material 2 is of filter paper formed by spraying and fixing the polypropylene resin slurry on the surface of the jute paper, and then the filter paper is folded into a loose cylinder which is arranged in the hollow structure of the filter body 1 as the filter core material. The inventors found that the filter paper sprayed with the polypropylene resin slurry by pulping a material with relatively poor plasticity such as polypropylene resin and combining with the paper can not only improve the overall strength of the finished product, but also ensure that the polypropylene resin material is evenly distributed in the filter body, therefore the smoke can be treated more evenly and for a longer time with more ideal air permeability. Moreover, polypropylene resin has stable properties at high temperature, no odor, and will not produce gases harmful to human body or affect the smoking feel.

Embodiment 4

Figure 7:
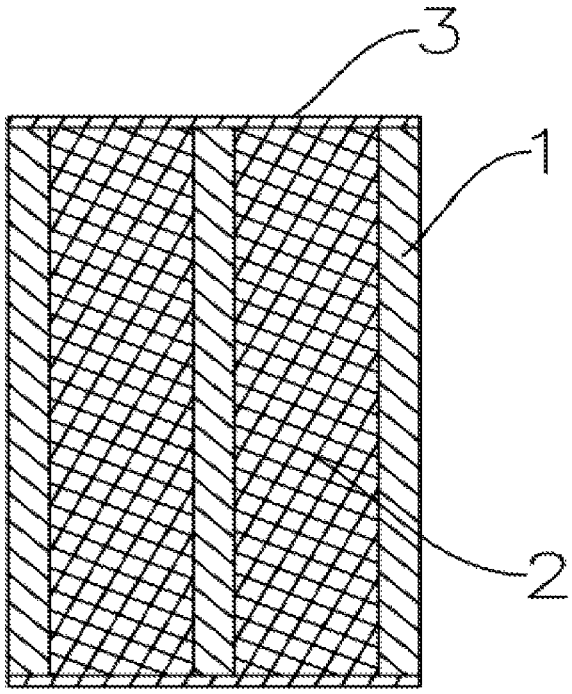
FIG. 7 is a structural diagram showing a filter component for smoking according to embodiment 4 of the present invention.
Figure 8:
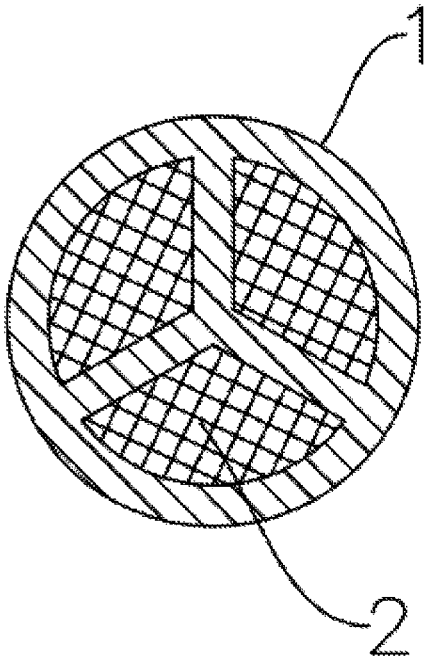
FIG. 8 is a schematic diagram of a cross section of the filter component for smoking according to embodiment 4.

As shown in FIGS. 7 and 8, the filter component for smoking according to embodiment 4 comprises a filter body 1, a filter core material 2 and a filter closing layer 3, where the filter closing layer 3 is of high-permeability pure wood pulp paper with an air permeability of 12000 CU, and both ends of the filter body 1 are closed by the filter closing layer 3 through food grade water-based adhesive. In the present embodiment, the filter body 1 is of a cylindrical structure made by starch molding, and a plurality of channels are formed therein. The filter core material 2 is of sand core made by high temperature sintering of quartz sand and is filled in the channels of the filter body 1.

In the present embodiment, the reason why the starch molding is used to manufacture the filter body 1 is to make full use of the advantages of sufficient starch source, being degradable, environment-friendly and hygienic, and convenience of molding channels with various structures in the body. The reason why the filter core material 2 is manufactured by high temperature sintering of quartz sand is to make full use of advantages of excellent filterability and cooling properties of quartz sand, which is convenient to sinter and form various forms. In the present embodiment, combination between the filter body 1 made by starch molding and the filter core material 2 made by high temperature sintering of quartz sand significantly improves the filterability and processability of the filter component for smoking according to embodiment 4, greatly simplifies the processing technology and greatly reduces the production cost.

Embodiment 5

Figure 9:
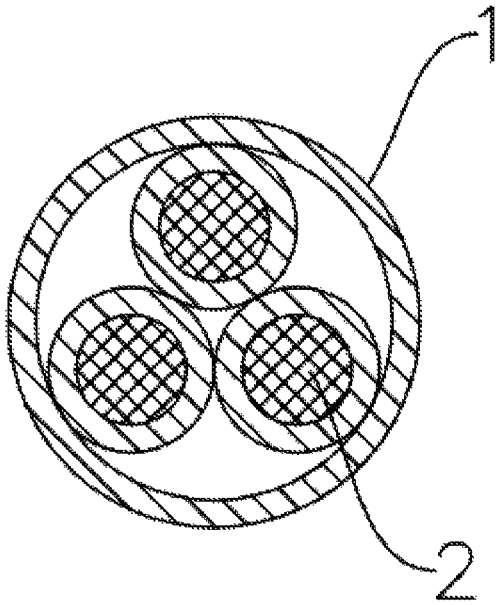
FIG. 9 is a schematic diagram of a cross section of the filter component for smoking according to embodiment 5 of the present invention.

FIG. 9 is a schematic diagram of a cross section of the filter component for smoking according to embodiment 5 of the present invention. As shown in FIG. 5, the filter component for smoking according to the present embodiment comprises a filter body 1, a filter core material 2 and a filter closing layer (not shown), where the filter body 1 is a hollow paper cylinder made by a spiral paper cylinder winding machine, and ends thereof are closed by the filter closing layer. The filter closing layer can be of 40 g/m$^2$ spunlace non-woven cotton.

It is particularly noted here that in embodiment 5, the filter core material 2 is composed of three independent built-in cylindrical filter core materials which are filled with polylactic acid fiber filaments which preferably have a linear density of 3.4 ktex. As shown in FIG. 9, the cylindrical filter core materials 2 are butted adjacent to each other and fixed in the filter body 1 by friction and butting pressure between the cylinder walls. Further, gaps between the cylindrical filter core materials and the interior of the cylindrical filter core materials form air flow filtration channels. Through a large number of experimental researches, the inventors proved that the "built-in filter core material structure" according to embodiment 5, as another ideal filter deformation structure, can not only effectively divert and filter smoke, but also flexibly adjust the internal structure of the filter component according to actual filtration requirements, which improves the processability.

The above description is only for the best embodiments of the present invention. It should be stressed that various modifications and improvements made to the present invention made by those of ordinary skill in the art without departing from the spirit of the present invention shall fall into the protection scope of the present invention.

What is claimed is:

1. A filter component for tobacco smoking, comprising a filter body, a filter core material and a filter closing layer, the filter body is a hollow cylinder, the filter core material is built in the filter body, and at least one end of the filter body is closed by the filter closing layer, and wherein the filter core material is a filament filter material, wherein the filament filter material is of a filament with a linear density of 3-6 ktex.

2. The filter component according to claim 1, wherein the filament filter material is of a filament with a linear density of 3.2-4.2 ktex.

* * * * *